US005359783A

United States Patent [19]

Smith

[11] Patent Number: 5,359,783

[45] Date of Patent: Nov. 1, 1994

[54] TILE SPACER FOR SIMULTANEOUSLY ALIGNING TILES ALONG THEIR WIDTH DURING SETTING

[76] Inventor: Freddie Smith, 6814 Hollow Hearth, Houston, Tex. 77084

[21] Appl. No.: 93,650

[22] Filed: Jul. 20, 1993

Related U.S. Application Data

[63] Continuation of Ser. No. 871,123, Apr. 20, 1992, abandoned.

[51] Int. Cl.[5] ..... G01B 3/30

[52] U.S. Cl. ..... 33/527; 33/526

[58] Field of Search ..... 33/19, 518, 526, 527

[56] References Cited

U.S. PATENT DOCUMENTS

| | | | |
|---|---|---|---|
| 1,742,103 | 12/1929 | Scholtes | 33/518 |
| 2,466,919 | 4/1949 | Skyes | 33/526 |
| 2,930,135 | 3/1960 | Rootz, Sr. | 33/526 |
| 3,010,213 | 11/1961 | Rootz, Sr. | 33/526 |
| 3,254,417 | 6/1966 | Carmichael et al. | 33/526 |
| 3,735,497 | 5/1973 | Boettcher | 33/526 |
| 3,775,856 | 12/1973 | Schmidt | 33/526 |
| 4,712,309 | 12/1987 | Kingston et al. | 33/527 |
| 4,793,068 | 12/1988 | Golkar | 33/526 |
| 4,860,723 | 8/1989 | Fortin | 33/526 |
| 4,899,455 | 2/1990 | Bovino et al. | 33/527 |

*Primary Examiner*—Thomas B. Will
*Attorney, Agent, or Firm*—Paul M. Denk

[57] ABSTRACT

A spacer for use in laying tile to produce grout joints having constant width includes a pair of cross-members which form four quadrants to receive four tiles. The spacer can be used with different sizes of tiles.

2 Claims, 2 Drawing Sheets

TILE SPACER FOR SIMULTANEOUSLY ALIGNING TILES ALONG THEIR WIDTH DURING SETTING

CROSS REFERENCE TO RELATED APPLICATION

This application is designated as a continuation of the application of the same inventor, having U.S. Pat. Ser. No. 07/871,123, filed on Apr. 20, 1992, now abandoned, said application being owned by a common assignee.

BACKGROUND OF THE INVENTION

This invention relates to devices to aid in the laying of tile, and in particular, to a tile spacer.

When laying tile for a tile floor, it is desirable that the tiles be evenly spaced apart for the finished floor to be a quality installation and to look nice. It is very desirable, particularly for the professional tile contractor, to have available a device which will enable him to evenly space tiles while laying them. Such a device is time saving, labor saving and cost effective. Several tile spacers have heretofore been produced. For example, U.S. Pat. Nos. 2,930,135 and 3,010,213, both to Rodtz, St. and 4,793,068 to Golkar, show tile setting gauges for use between tiles. These spacers, however, have very short spacing members. Thus, using these spacers, it would be difficult to align the tiles so that the grout joint is even along the full length of the tile due to possible slipping or moving of the tile when setting the tile. Further, these spacers do not have an easily accessible handle, making their removal from between the tiles following the alignment difficult. The use of these spacers is further disadvantageous in that their removal can not occur until after the tile adhesive has completely hardened.

U.S. Pat. Nos. 3,254,417, to Carmichal, St. and 3,775,856 to Schmidt, show tile setting templates. As shown, these templates have rather limited use. They can only be used for a specific sized tiles and cannot be used in laying all the tile in a room. Due to the size of the template, it is difficult to use in small spaces when the room is nearly completed.

Lastly, U.S. Pat. No. 3,735,497, to Boettcher, shows a spacer which is used in laying floorboards. This is a short spacer, and thus would not facilitate the laying of the boards perpendicularly to each other. It therefore has the same drawbacks as does the Golkar and Rodtz tile spacers.

SUMMARY OF THE INVENTION

One object of this invention is to provide a tile spacer for use in spacing tiles.

Another object is to provide such a tile spacer which may be used with a plurality of different sized tiles.

Another object of this invention is to provide such a tile spacer which would facilitate the laying of tiles perpendicularly to each other to obtain evenly sized grout joints throughout a room.

These and other objects will become apparent to those skilled in the art, in view of the following disclosure and accompanying drawings.

In accordance with the invention, generally stated, there is provided a tile spacer for use in laying multiple sizes of tiles. The tile spacer includes a pair of cross-members which are generally perpendicular to each other and a handle. The cross-members extend from a cross point a distance equal to at least one-fourth the width of the tile.

DESCRIPTION OF THE PREFERRED EMBODIMENT

Figure 1:
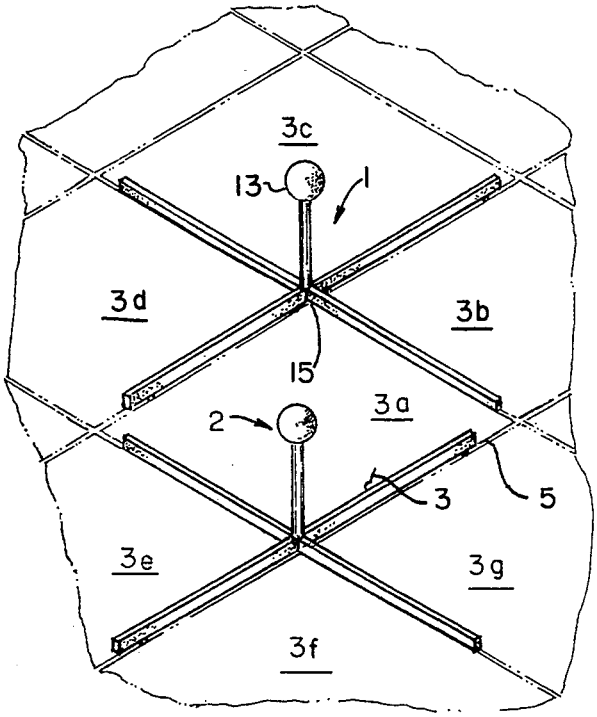
FIG. 1 is an isometric view of tile spacers of the present invention in use.
Figure 3:
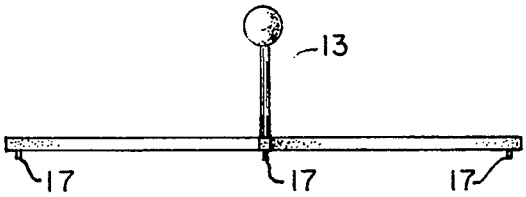
FIG. 3 is a side view of the tile spacer.
Figure 2:
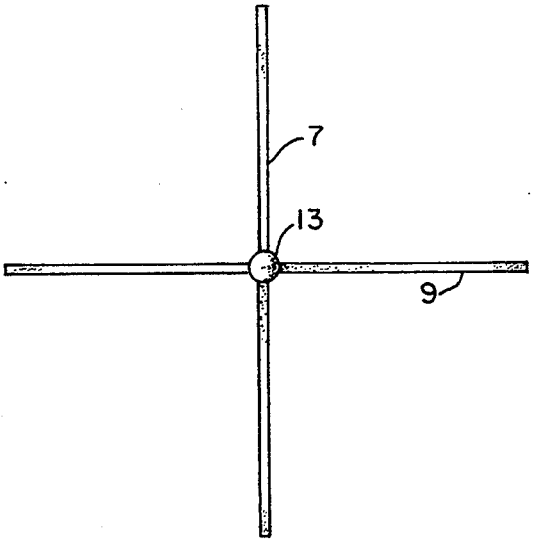
FIG. 2 is a top view of the tile spacer.
Figure 4:
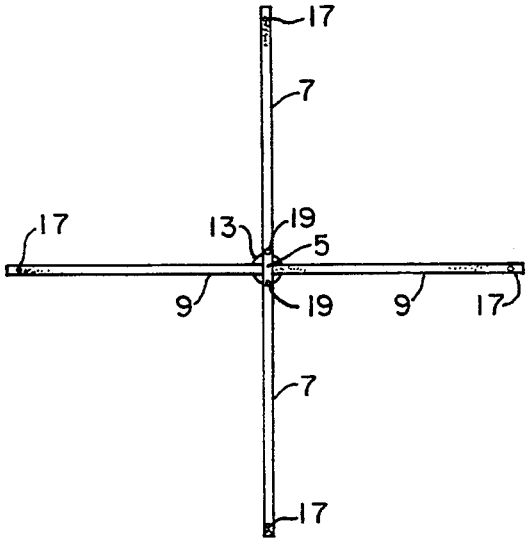
FIG. 4 is a bottom view of the tile spacer.

Referring to the Figures, reference numeral 1 generally refers to a tile spacer which is used to lay tiles 3 a set distance from each other in order to Obtain grout joints 5 which are of uniform and constant width. Tile spacer 1 is seen to include cross-members 7 and 9 which are joined in a generally perpendicular relationship. Cross-members 7 and 9 are generally rectangular in cross-section with the vertical edges preferably being longer than the horizontal edges.

Cross-members 7 and 9 cross at a point 15, approximately equidistant from the ends of both members to create a space having four quadrants which can accept four tiles 3*a*–3*d*. A handle 13 extends up from cross-over point 15. The bottoms of members 7 and 9 each have pins 17 near the outer ends thereof. Member 7 also has a pair of pins 19 near the center thereof, approximately directly beneath handle 13. Pins 19 are on member 7 opposite sides of member 9. Two pins 19 are preferred, but four may be used. When four pins are used the second pair of pins are placed on member 9 on opposite sides of member 7.

The cross-members each extend a sufficient distance from the cross-over point 15 so that the tiles can be laid perpendicularly to each other at a set, constant distance from each other along their lengths without the need of very meticulously laying the tiles to obtain grout joints of constant widths. Preferably, the cross-members are at least one-fourth the length of the tile being laid.

Members 7 and 9 can be made to different widths to provide for different sized grout joints. For example, they can be $\frac{1}{8}''$, $\frac{1}{4}''$, $\frac{3}{8}''$, or $\frac{1}{2}$ in width. These are common sizes for grout joints.

The length of the members 7 and 9 can vary to accommodate varying sizes of tiles. For example, members 7 and 9 can extend $5\frac{1}{2}''$ from cross-over point 15 for use with $6''\times6''$ tiles and $7\frac{1}{2}$ for use with $8''\times8''$, $10''\times10''$, $12''\times12''$, $13''\times13''$, or $16''\times16''$ tiles. Alternatively, an attachment can be provided which can be mounted on the cross-members so that they may be lengthened in order to accommodate differently shaped tiles, e.g. rectangular $4''\times8''$ tiles. It will be seen that one size of the tile spacer can accommodate a plurality of tile sizes.

In use, after a tile adhesive has been spread on a floor, the spacer 1 is set in the adhesive. The pins 17 and 19 which extend down from the cross-members will hold members 7 and 9 above of the adhesive at a level where the tiles can be urged against the cross-members. Tiles 3*a*–*d* are placed in the four quadrants and maneuvered so that two sides of each tile are adjacent to the vertical wall of the members 7 and 9. Once the tiles are positioned, the second spacer 2 is then placed adjacent tile 3*a* (as shown in FIG. 1) and tiles 3*e*–3*g* are set into place around spacer 2. Spacer 1 is then moved to another position, e.g. adjacent tile 3*b* and three more tiles are set into place in the three open quadrants, then spacer 2 is moved to a position adjacent to a tile already set in place and three more tiles are set into the open quadrants of spacer 2. This process continues until the entire room has been tiled. In this fashion, a room can be tiled and the grout joints can be kept to a constant width.

Figure 5:
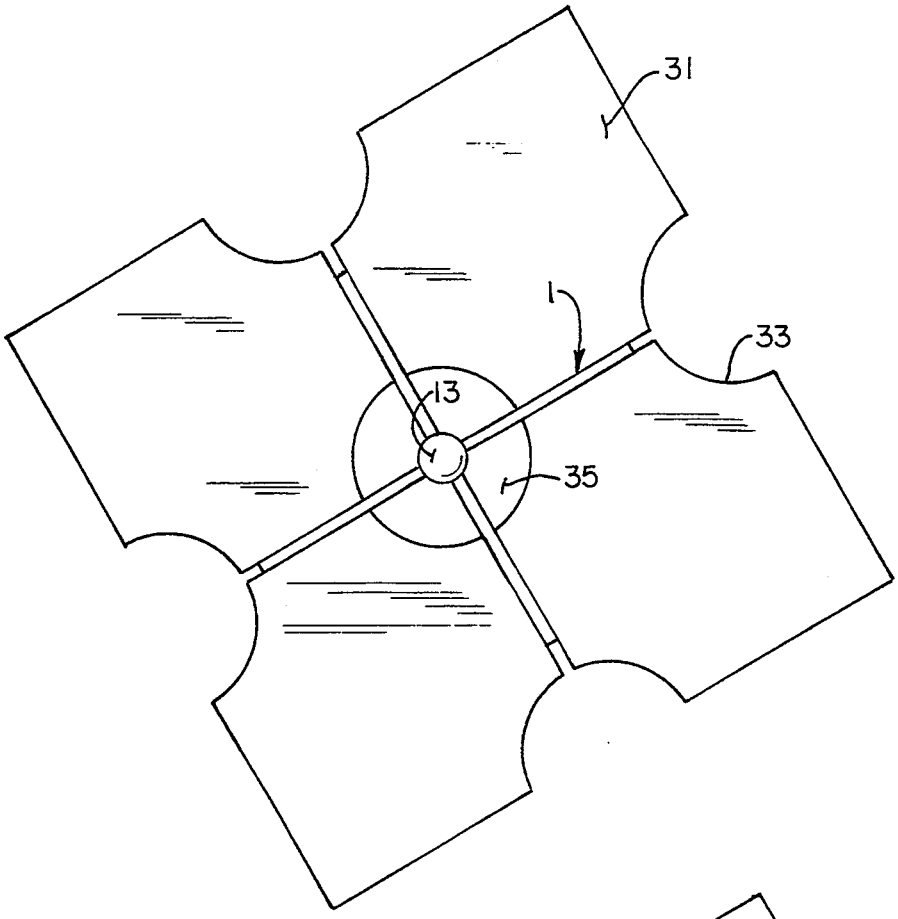
FIG. 5 is a top plan view of the tile spacer in use to space four tiles having cut outs at their corners to receive a dot tile.
Figure 6:
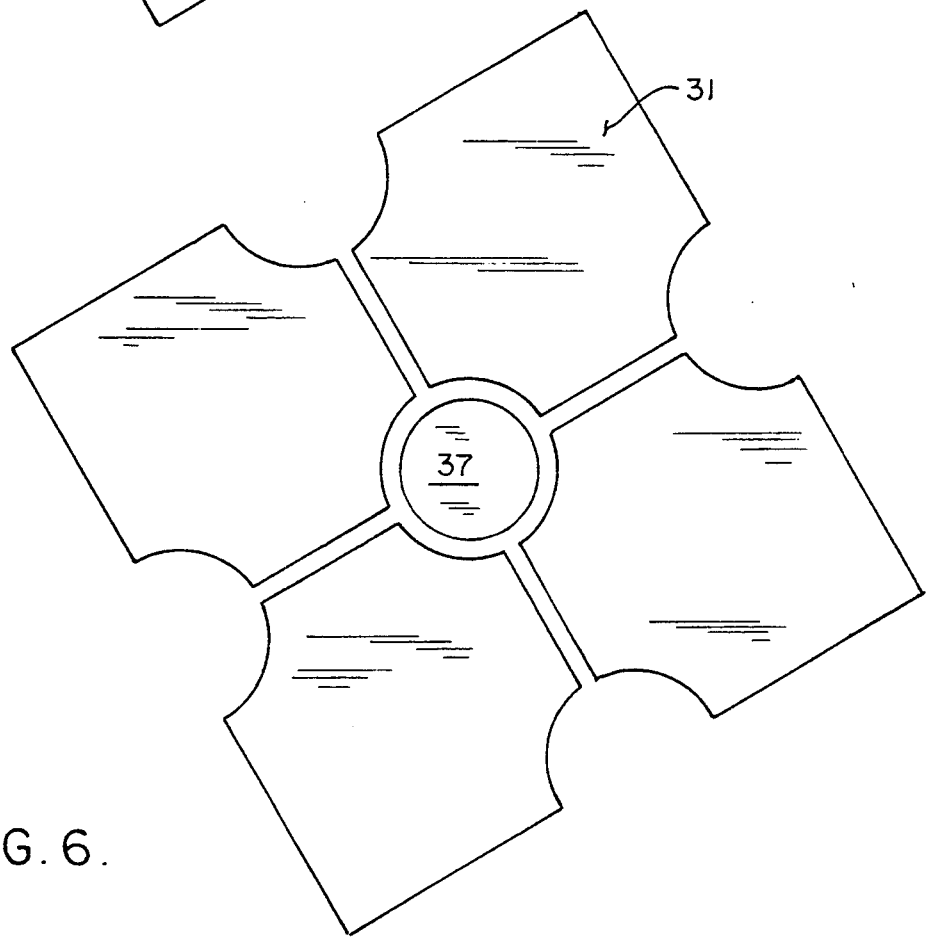
FIG. 6 is a top plan view of the tiles of FIG. 5 with the dot tile in place.

In FIGS. 5 and 6, the tile spacer 1 is shown with tiles 31 which have cutouts 33 at their corners to define an area 35 between the tiles which receive a dot tile 37. When the tiles 31 are laid using the tile spacer 1 as described above, the area 35 will automatically be formed at the proper size to receive dot tile 37. Tile spacer 1 can thus be used to set tiles having shapes other than square or rectangular, as long as the tile has at least two straight edges.

In view of the above, it will be seen that the various objects and features of this invention are achieved and other advantageous results obtained. As various changes could be made in the above constructions without departing from the scope of the invention, it is intended that all matter contained in the above description or shown in the accompanying drawing shall be interpreted as illustrative and not in a limiting sense.

Having thus described the invention, what is claimed and desired to be secured by Letters Patent is:

1. A method of spacing tiles being laid comprising the steps of:

(a) providing a tile spacer comprised of a pair of cross-members intersecting at a cross point and which are generally perpendicular to each other, and having a handle extending upwardly therefrom at the cross point, the cross-members extending from the cross point a substantial distance to approximately the width of the tiles to be laid, each cross-member having an outer end, said pair of cross-members forming four quadrants in the tile spacer, (b) placing said tile spacer at the desired location of the tiles, (c) placing at least one tile in adjacent quadrants so that two sides of said at least one tile in each quadrant are adjacent the walls of the two cross-members that form the respective quadrant so that a grout joint between the two adjacent tiles is evenly spaced.

2. The method of claim 1 including the step of elevating the tile spacer above the surface on which the tiles are laid by providing pins extending downwardly from the undersides of the cross-members, one of said pins extending downwardly at approximately the outer end of each cross member, and at least one additional pin extending downwardly from the cross-members near the location of the cross point.

* * * * *